United States Patent [19]

Onishi

[11] Patent Number: 4,628,886

[45] Date of Patent: Dec. 16, 1986

[54] FUEL INJECTION SYSTEM FOR INTERNAL COMBUSTION ENGINE

[75] Inventor: Akito Onishi, Toyota, Japan

[73] Assignee: Toyota Jidosha Kabushiki Kaisha, Toyota, Japan

[21] Appl. No.: 760,555

[22] Filed: Jul. 30, 1985

[30] Foreign Application Priority Data

Dec. 5, 1984 [JP] Japan ..... 59-257070

[51] Int. Cl.[4] ..... E02M 17/00

[52] U.S. Cl. ..... 123/491; 123/179 L

[58] Field of Search ..... 123/179 L, 491

[56] References Cited

U.S. PATENT DOCUMENTS 4,126,107 11/1978 Harada ..... 123/491
4,148,283 4/1979 Harada ..... 123/491
4,240,383 12/1980 Horbelt ..... 123/491
4,432,325 2/1984 Auracher ..... 123/491
4,487,189 12/1984 Horbelt ..... 123/491
4,508,084 4/1985 Yamato ..... 123/491

*Primary Examiner*—Ronald B. Cox
*Attorney, Agent, or Firm*—Kenyon & Kenyon

[57] ABSTRACT

A system for controlling the fuel injection amount in an internal combustion engine. The fuel injection amount is calculated based on the ratio of the amount of intake air measured by an air flow meter to the engine speed. The injection amount is maintained at not less than a predetermined minimum amount during the starting of the engine even if an undershoot occurs in the signal level from the air flow meter after the starter has been switched off. Thus, a sharp decrease in the engine speed is prevented, and thus engine stalling is also prevented.

5 Claims, 14 Drawing Figures

Fig.6a IGSW
Fig.6b ST(40)
Fig.6c N
ℓ
ℓ'
N1
N2
Fig.6d Q/N
(Q/N)MIN
n
Fig.6e XSTA
1
0
Fig.6f CSTA
α
m
p
Fig.6g TAU
TSTA
O'
O
Tp
t1
to
t2

FUEL INJECTION SYSTEM FOR INTERNAL COMBUSTION ENGINE

BACKGROUND OF THE INVENTION

1. Field of the Invention

The present invention relates to a fuel injection system in an internal combustion engine wherein the amount of fuel to be supplied to the engine is controlled by signals from an air flow meter, for example, having a plate rotatably arranged in the intake pipe of the engine and a potentiometer connected to the plate at its axis of rotation. The present invention is intended to be applied for control of the fuel injection amount when the engine is started.

2. Description of the Related Art

In a fuel injection control system the amount of air introduced into the engine is sensed by an air flow meter, and engine speed is sensed by an engine speed sensor, to obtain a desired ratio Q/N of intake air amount to engine rotational speed. A basic fuel injection period Tp is obtained from Q/N multiplied by a constant Kt, and a final fuel injection period TAU is obtained from the basic fuel injection period Tp to which various corrections are applied in accordance with various requirements of the engine, such as air fuel ratio feedback control, air fuel ratio learning control, enrichment during warming-up control, and the like. Fuel injectors are operated in such a manner that they are opened during the calculated period TAU at a predetermined timing of the engine.

In this type of fuel injection system, an abrupt decrease in engine speed is sometimes generated, causing the engine to stall, even after a full ignition state has been attained for the engine by the operation of a starter. This stalling occurs because of an "undershoot" in the output signal level of the signal from the air flow meter just after the starter is stopped, which undershoot causes the value of the ratio Q/N of intake air amount to engine speed to decrease, and thus the amount of fuel to be injected is also decreased.

SUMMARY OF THE INVENTION

An object of the present invention is to provide a fuel injection system for an internal combustion engine, capable of preventing the engine from stalling due to an undershoot in the signal from the air flow meter.

According to the present invention, a fuel injection control system for an internal combustion engine is provided, comprising:

- injector means for introducing fuel into said engine;
- first detecting means for detecting intake air amount introduced into said engine;
- second detecting means for detecting engine speed;
- calculating means, connected to said first and second detecting means, for calculating a ratio of said intake air amount to said engine speed;
- means for calculating an amount of fuel to be injected in accordance with said calculated ratio;
- timer means for detecting a predetermined period from the start of said engine until stable idling is assured;
- means for compensating said calculated amount of fuel to be not less than an amount corresponding to a predetermined limit value of a fuel-related parameter during said period; and
- means for operating said injector means so that the compensated amount of fuel is injected into said engine.

DESCRIPTION OF THE PREFERRED EMBODIMENTS

The embodiments of the present invention will be described hereunder with reference to the attached drawings.

Figure 1:
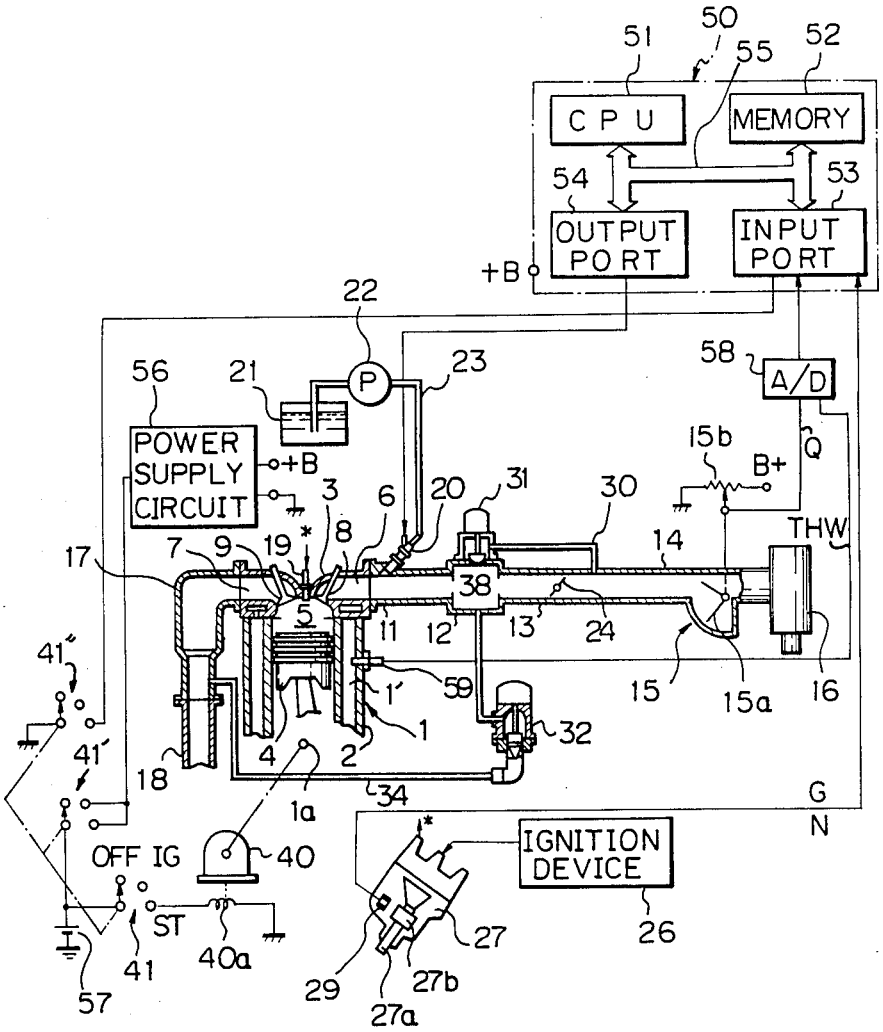
FIG. 1 is a schematic view of the fuel injection system according to the present invention.

In FIG. 1, reference numeral 1 denotes generally an internal combustion engine. The engine 1 includes a cylinder block 2 and a cylinder head 3. A piston 4 is arranged in the cylinder block 2, and a combustion chamber 5 is formed above the piston 4. The cylinder head 3 is provided with an intake port 6 and an exhaust port 7, which are opened to the combustion chamber 5 via an intake valve 8 and an exhaust valve 9, respectively.

The exhaust port 7 is connected to an exhaust manifold 17, which is connected to an exhaust pipe 18.

The intake port 6 is connected, via an intake manifold 11, a surge tank 12, a throttle body 13, an intake pipe 14, and an air flow meter 15, to an air cleaner 16. A throttle valve 24 connected to an accelerator pedal (not shown) is arranged in the throttle body 13. A by-pass passageway 30 is connected at one end to the intake line upstream from the throttle valve 24, and at the other end, the by-pass passageway 30 is connected, via a by-pass control valve 31, to the surge tank 12 downstream from the throttle valve 24. This by-pass system controls engine idling speed, and the construction thereof will not be specifically described since it is well known per se to those skilled in this art.

A spark plug 19 is fixed in the cylinder head 3. The spark plug 19 is connected to a distributor 27, and an ignition device 26 is connected to the distributor 27 in such a manner that a spark arc is generated in the spark plug electrodes (not shown) in the combustion chamber 5 at a selected timing, as is also well known to those skilled in this art.

A fuel injector 20 is arranged on the intake manifold 11 near the intake port 6. The injector 20 is connected, via a fuel pipe 23 and a fuel pump 22, to a fuel tank 21, and fuel in the tank 21 is supplied to the engine 1 when the injector 20 is operated.

An exhaust gas recirculating passageway 34 connects the intake manifold 17 to the surge tank 12, via a valve 32 arranged in the passageway 34 for controlling the amount of exhaust gas to be recirculated.

The air flow meter 15 is provided with a measuring plate **15*a* located in the intake pipe 14 in such a manner that the angular position of the plate 15*a* is changed in accordance with the amount of intake air passing through the intake pipe 14, and provided with a potentiometer 15*b*, which, in response to the angular position of the measuring plate 15***a*, issues an analog signal indicating the amount of intake air Q.

The distributor 27 is provided with a distributor shaft 27*a* for providing ignition to a plurality of spark plugs 19 in a predetermined sequence, the shaft 27*a* being connected to a crankshaft 1*a* of the engine 1. A crank angle sensor system 29 is arranged in the distributor 27 in such a manner that it faces a detecting piece 27*b* arranged on the distributor shaft 27*a*, and as a result, pulse signals are obtained from the sensor system 29. As is well known, the system 29 issues two types of pulse signals: Namely, pulse signals (first signals) issued at a small crank angle (CA) rotation, such as every 30 degrees, and pulse signals (second signals) issued at a large crank angle rotation such as every 720 degrees, corresponding to one four-stroke engine cycle. The first signals serve to obtain data related to engine speed N, and the second signals serve to obtain reference data.

The crankshaft 1*a* is connected to a starter motor 40 through a transmission member (shown by the dotted line). The starter 40 is provided with a solenoid coil 40*a* through which a closed circuit is realized when a switch 41 operated by a key is turned to an ST position.

Reference numeral 50 denotes a control circuit, i.e., a microcomputer system, having a central processing unit (CPU) 51, a memory 52, an input port 53, an output port 54, and a bus 55 connecting these elements with each other. Power to the control circuit 50 is supplied by a power supply circuit 56 connected to a battery 57 via a switch 41' operated by the key at the IG and ST positions.

The potentiometer 15*b* of the air flow meter 15 is connected to an analog-to-digital (A/D) converter 58. Also connected to the A/D converter 58 is a temperature sensor 59 for detecting the temperature of cooling water contained in the water jacket 1' in the engine body 1. The temperature sensor 59 is formed as a thermistor providing an analog signal corresponding to the temperature THW of the cooling water. The A/D converter 58 is connected to the input port 53 and transforms the analog signals Q indicating the intake air amount and THW indicating the cooling water temperature into digital signals to be input to the input port 53. The crank angle sensor device 29 is connected to the input port 53, and a pulse signal N for every 30° CA and a pulse signal G for every 720° CA are input to the input port 53.

A switch 41" operated by the key is further provided, and is connected to the input port 53. When the key is moved to the starter ST position, the switch 41" is made ON and thus the state of the input port is changed from high level to a low level, allowing the ST position of the key to be detected.

Various other sensors, for example, an air fuel ratio sensor, a throttle position sensor, and intake air temperature sensor, are connected to the input port 53 for detecting other operating conditions. These signals are also used for attaining fuel injection control, but, since these operation are not directly related to the present invention, an explanation thereof will be omitted.

The output port 54 is connected to the fuel injectors 20.

The memory 52 is provided with programs for operating the CPU 51 to calculate the amount of fuel to be injected in accordance with the engine conditions detected by the above described sensors and the sensors for which an explanation was not given. The calculated data related to the amount of fuel to be injected is issued to the output port 54, to operate the fuel injectors 20 accordingly. The programs mentioned above will be described in detail later.

The memory 52 may also be provided with programs for operating other units, such as the ignition device 26, the by-pass control valve 31, and the exhaust gas recirculation control valve 32. However, these are not directly related to the present invention and therefore an explanation thereof is omitted.

Figure 2:
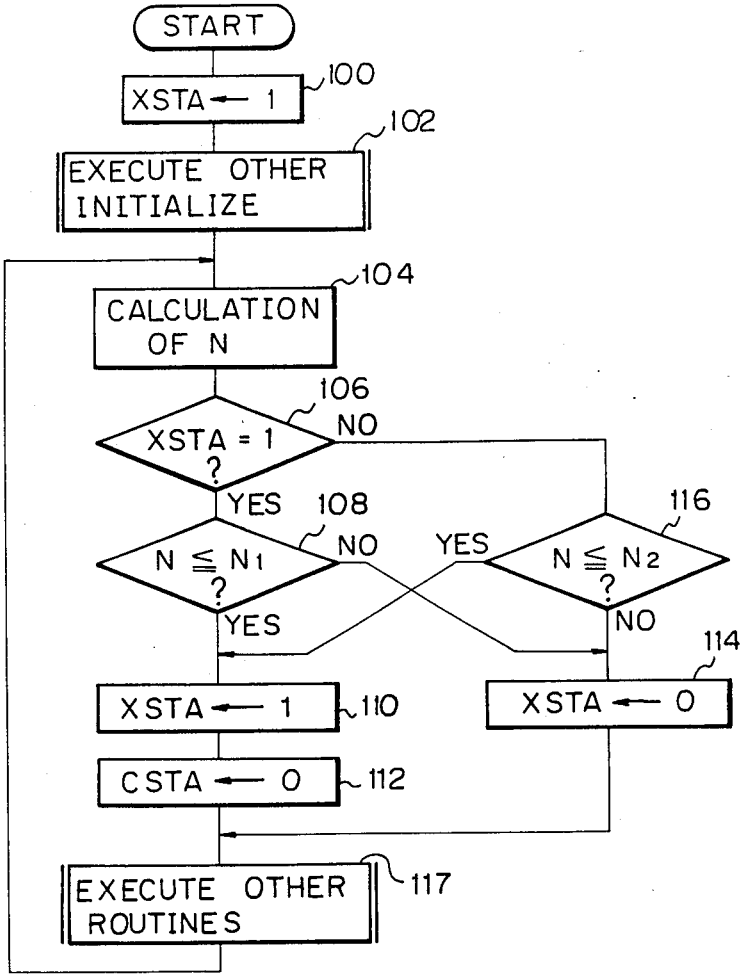
FIGS. 2 to 4 show flow charts for attaining the operation of the present invention.

FIG. 2 indicates a main routine which enters into calculation when the ignition key is turned to an IG position. At point 100, a flag XSTA is initialized to "1". This flag XSTA is "1" until engine speed is increased to a value N1, such as 400 r.p.m., to allow the engine to be brought to a full ignition state. The flag XSTA is reset to "0" if the engine speed subsequently decreases to a value N2, which is slightly lower than N1.

At point 102, treatments for initializing other memory addresses or resistors are attained.

At point 104, engine speed N is calculated from the pulse signals for every 30 degrees of crank angle from the crank angle sensor device 29. At point 106, it is determined whether or not the flag XSTA is 1. When the engine is to be started, the flag XSTA is 1 as a result of the initializing at point 100. The program then proceeds to point 108 where it is judged whether or not the engine speed N as sensed has reached the predetermined level N1, at which level N1 the engine is regarded as having attained a full ignition condition. If the engine speed has not reached the level N1, the program proceeds to a point 110 where the flag XSTA is set to "1". At the next point 112, a counter CSTA is reset to "0". This counter CSTA measures the lapse in time following each resetting to "0".

When the engine speed N has reached the predetermined level N1, the program flows from point 108 to point 114 where the flag XSTA is reset to "0". Therefore, when this program executes step 106 at the following cycle, the routine flows from point 106 to point 116, where it is determined whether or not the engine speed N as sensed has decreased below a predetermined level N2, such as 300 r.p.m. If the engine speed N as sensed is still higher than the predetermined level N1, the program flows to point 114 to maintain the flag at "0". If the engine speed N subsequently decreases below the predetermined value N2, the program then proceeds again to point 110 to set the flag XSTA to "1" and then to point 112 to clear the counter CSTA.

In FIG. 2, the reference numeral 117 generally indicates various steps carried out in the main routine, an explanation of which is omitted, since they are not directly related to this invention. After the execution of the step 117, the program goes to point 104 in order to repeat the steps following step 104.

Figure 3:
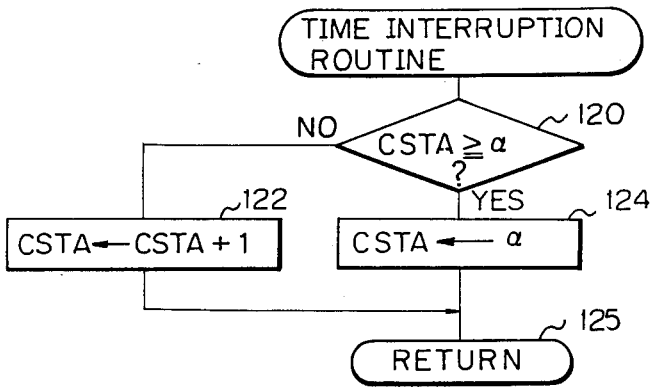

FIG. 3 shows the routine for controlling the counter CSTA. This routine is effected for every predetermined time period, such as 2 msec. At point 120, it is determined whether the value at the CSTA is larger than a predetermined value $\alpha$, which corresponds to a predetermined elapsed time such as a time within a range of 0.5 to 3 seconds. When the value of CSTA is lower than the predetermined value $\alpha$, the program proceeds to point 122 where the value of the counter CSTA is incremented by 1. When the value of the counter CSTA is larger than the predetermined value $\alpha$, the program proceeds to point 124 where the value of the counter CSTA is fixed to $\alpha$. At point 125, the program returns to the main routine.

Figure 4:
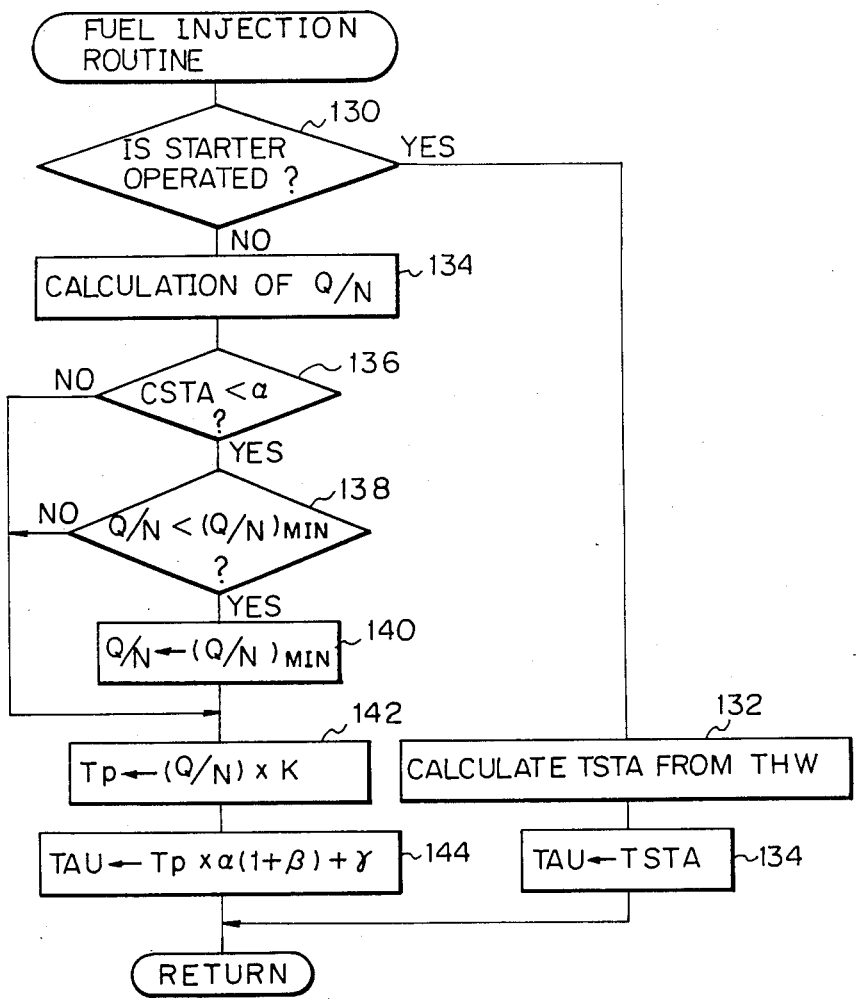
Figure 5:
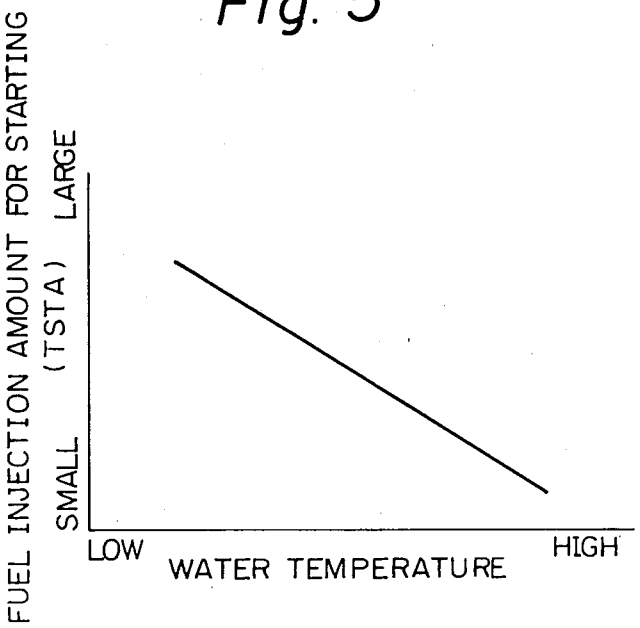
FIG. 5 shows a relationship between cooling water temperature and injection fuel amount during startup.

FIG. 4 shows a routine for calculating the period for operating an injector 20. This routine enters into execution at every predetermined crank angle detected by the crank angle sensor 29. At point 130, it is determined whether or not the starter 40 is operated. When the starter 40 is operated, the switch 41'' is made ON, and the program proceeds to point 132 where a fuel injection period for the starting operation TSTA is calculated from the temperature of the cooling water THW sensed by the temperature sensor 59. The memory 52 is provided with a map indicating the relationship between the water temperature and the fuel injection amount for starting. The CPU 51 calculates the TSTA corresponding to the sensed water temperature THW from the map in the memory 52, as shown in FIG. 5. At point 134, the TSTA data is moved to a memory area storing data of TAU.

When operation of the starter 40 is stopped, the switch 41'' is made OFF and the program proceeds from point 130 to point 134, where a ratio Q/N of the intake air amount sensed by the air flow meter 15 to the rotational speed is calculated. The program then proceeds to point 136 where it is determined whether the value of the counter CSTA is smaller than $\alpha$, i.e., a predetermined time has not yet lapsed after the engine speed has attained the value of N1. When the value of the counter CSTA is smaller than the value $\alpha$, the program proceeds to point 138 where it is determined whether the value of Q/N is smaller than a predetermined lower limit $(Q/N)_{MIN}$ having a value, for example, in the range of 0.15–0.3 1/rev. When the value of Q/N is smaller than $(Q/N)_{MIN}$, the program proceeds to point 140 where the value of $(Q/N)_{MIN}$ is moved to Q/N. When the value of Q/N is not smaller than $(Q/N)_{MIN}$, step 140 is by-passed.

When the value of the counter CSTA is not smaller than $\alpha$, steps 138 and 140 are by-passed.

At point 142, a basic fuel injection period Tp is calculated from $(Q/N)\times K$, where K is a constant. At point 144, a final fuel injection period TAU is calculated from the following equation.

$$TAU = Tp \times \alpha(1+\beta)+\gamma$$

In the above equation, $\alpha$, $\beta$, and $\gamma$ represent correction factors and or correction amounts for correcting the basic fuel injection period Tp in accordance with various engine factors, such as feedback, acceleration/deceleration, air-fuel ratio learning control, warming-up enrichment, and so on.

The final injection period TAU thus calculated is issued to the output port 54, and the fuel injector 20 is then operated in such a manner that it is opened during the calculated period TAU. Thus, the injection of the calculated amount of fuel is attained.

Figure 6:
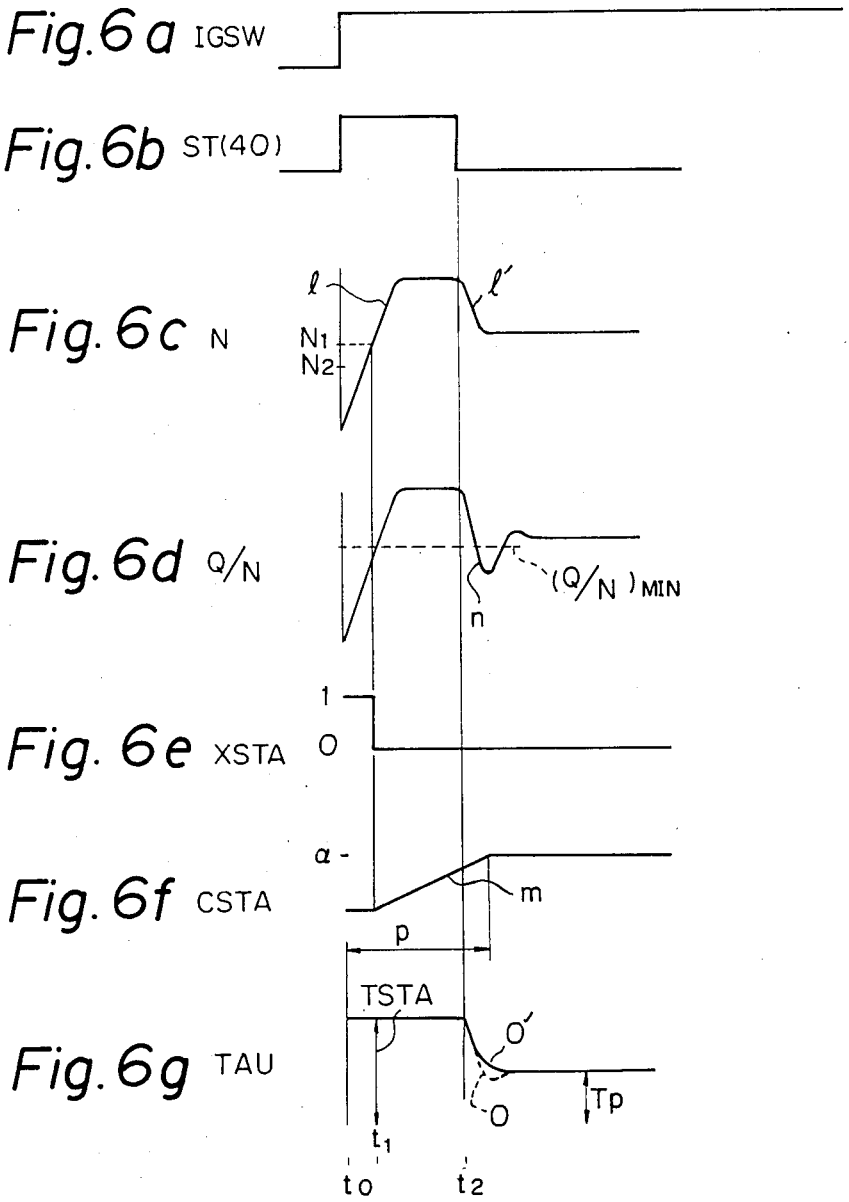
FIG. 6 shows time charts illustrating the operation of the present invention.

FIG. 6 shows the steps in operation according to the present invention. The ignition key is turned and the switch 41 is moved to the ST position, to operate the starter 40 at time t0 (FIG. 6-*b*). Thus, the engine speed N begins to increase as shown by a line l in FIG. 6-*c*. The fuel injection amount TAU is based on the TSTA (FIG. 6-*g*) calculated at point 132 in the routine shown in FIG. 4. When the engine speed N is increased to the value N1 (FIG. 6-*c*) at time T1, the flag XSTA is reset as shown by FIG. 6-*e* as a result of the execution of step 114 in FIG. 2, while the counter CSTA is cleared and then begins to gradually increase as shown by a line m in FIG. 6-*f*.

Note that, if the engine speed N drops to a value below the predetermined level N2 during the start operation, the flag XSTA is again set to "1", the counter CSTA is again cleared at steps 110 and 112 (FIG. 2), and the above operation is then repeated.

When the starter 40 is switched off at time t2, the fuel injection period is shortened since the calculation of TAU is mainly based on the basic injection period Tp at the steps 142 and 144 in the routine shown in FIG. 4. As a result, the engine speed drops as shown by a line l' in FIG. 6-*c*. Due to the so-called "under shoot" effect, the value of Q/N sensed by the air flow meter 15 abruptly decreases to a value below a predetermined limit value as shown by a line n in FIG. 6-*d*. As a result, the value of Q/N becomes smaller than the predetermined limit value $(Q/N)_{MIN}$, which causes the fuel injection amount TAU calculated from Q/N to be decreased as shown by a dotted line o in FIG. 6-*g*, which may cause the engine 1 to stall. According to the present invention, during the period P from the beginning of the start of the engine 1, wherein the value of the counter TSTA does not reach the value $\alpha$, $(Q/N)_{MIN}$ is moved to Q/N when the value of Q/N decreases below $(Q/N)_{MIN}$. As a result, TAU is corrected so as to change as shown by a solid line o' in FIG. 6-*g*. Thus, engine stalling is prevented.

Note that the predetermined value $\alpha$ to be counted by the counter CSTA, which corresponds to the time period P beginning when the key is switched to the ST position, is determined based on the usual duration time of the operation of the starter 40 when the engine 1 is to be started. The value of $\alpha$ is selected so that the period is, for example, within a range of from 0.5 to 3 seconds. Since the value of $\alpha$ is selected so that the maintenance of the predetermined limit value $(Q/N)_{MIN}$ of Q/N is limited in a restricted short period from the start of the engine operation, this logic for correcting Q/N to the limit value $(Q/N)_{MIN}$ is not operative during racing of the engine 1, which sometimes occurs during idling just after the engine 1 has started, and therefore the value Q/N for calculating the fuel injection amount during such conditions can be decreased below the limit value $(Q/N)_{MIN}$. Thus a stable idling operation is not influenced in any way by the logic realized by the present invention.

Figure 7:
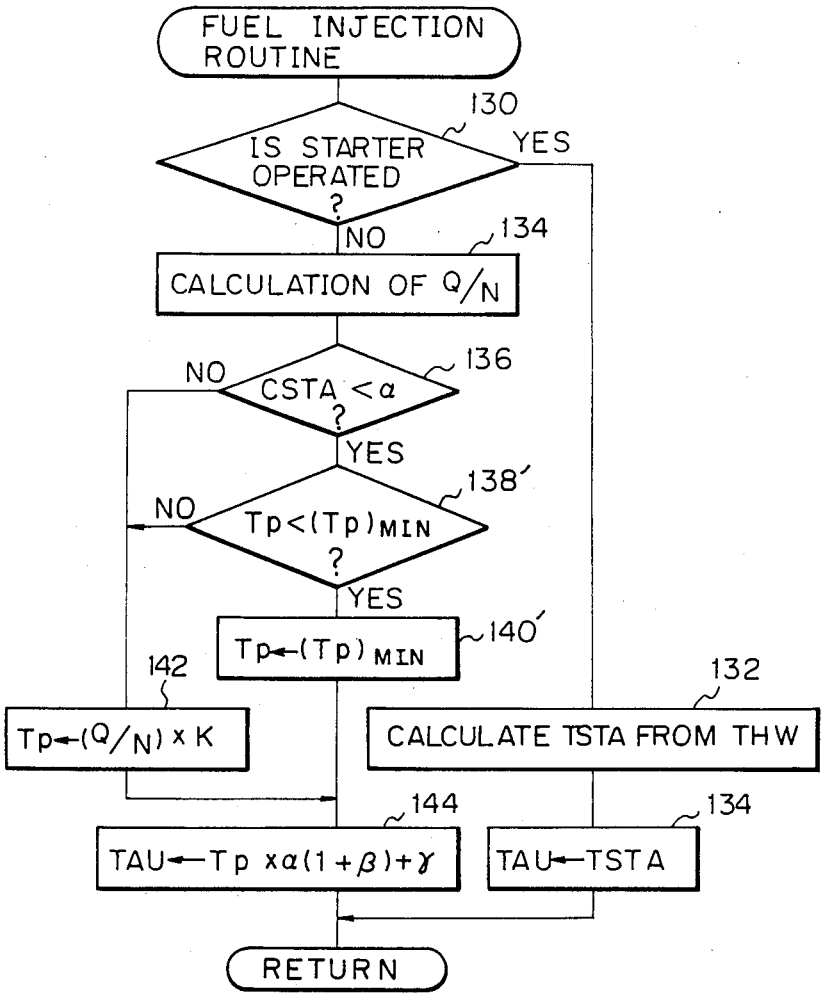
FIGS. 7 and 8, respectively, show modifications of the operation of the present invention shown in FIG. 4.

FIG. 7 shows a flow chart of the fuel injection routine in a second embodiment of the present invention. This embodiment differs from that shown in FIG. 4 only in that, for the basic fuel injection period Tp, a minimum value of the base fuel injection period $(Tp)_{MIN}$ is employed as the predetermined limit value of a fuel-related parameter when the basic fuel injection period Tp becomes smaller than the minimum value, having a value of, for example, 1.6 msec. At point 138' it is determined whether the value of the calculated Tp is smaller than $(Tp)_{MIN}$. When the result of the determination at point 138' is "yes", then the program proceeds to point 140' where the value of $(Tp)_{MIN}$ is moved to Tp. Other steps in FIG. 7 are the same as the steps in FIG. 4, and therefore an explanation thereof is unnecessary in that the same numbers are attached to the steps attaining the same operations. In this embodiment, the value of Tp is maintained at not less than $(Tp)_{MIN}$ when an overshoot occurs in the output of the air flow meter just after the starter is de-energized. Thus, a minimum fuel injection amount is maintained to prevent the engine 1 from stalling.

Figure 8:
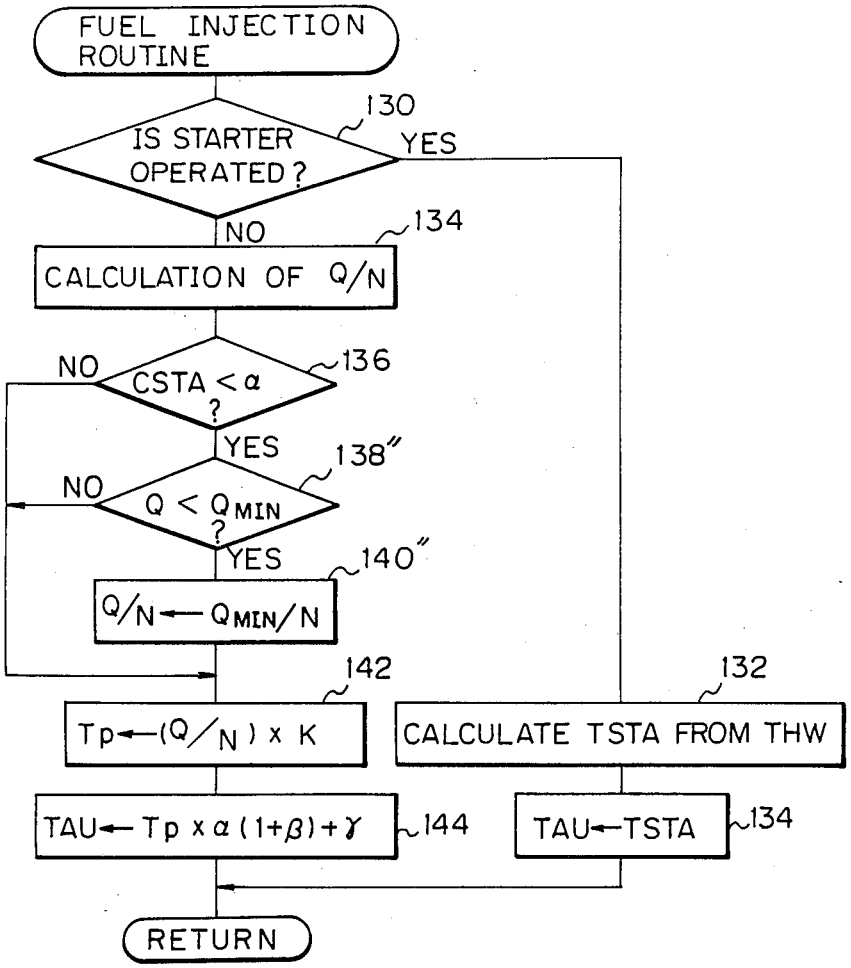

FIG. 8 shows a flow chart of the fuel injection routine in a third embodiment of the present invention. This embodiment differs from the embodiment shown in FIG. 4 only in that, as the predetermined limit value of a fuel-related parameter, a minimum value $Q_{MIN}$ is employed . At a point 138' it is judged whether the value of Q is smaller than the minimum value $Q_{MIN}$. At the point 140'' the minimum value $Q_{MIN}/N$ is moved to Q/N. Other steps in FIG. 8 are the same as the steps in FIG. 4 and are given the same reference numbers. In this embodiment, the fuel injection amount is maintained at not less than an amount calculated for $Q_{MIN}/N$ during the starting of the engine 1 to prevent the engine from stalling.

Although the present invention is described with reference to the attached drawings, many modifications and changes can be made by those skilled in this art without departing from the scope and spirit of the present invention.

I claim:

1. A fuel injection control system for an internal combustion engine, comprising:

starter means for initiating a start of said engine;

injector means for introducing fuel into said engine;

first detecting means for detecting air intake amount introduced into said engine;

second detecting means for detecting engine speed;

calculating means, connected to said first and second detecting means, for calculating a ratio of said air intake amount to said engine speed;

means for calculating an amount of fuel to be injected in accordance with said calculated ratio;

timer means for detecting a predetermined period from the start of said engine until stable idling is assured;

means for compensating said calculated amount of fuel to be not less than an amount corresponding to a predetermined limit value of a fuel-related parameter during said period; and means for operating said injector means so that the compensated amount of fuel is injected into said engine.

2. A fuel injection control system for an internal combustion engine, comprising:

starter means for initiating a start of said engine;

injector means for introducing fuel into said engine;

first detecting means for detecting air intake amount introduced into said engine;

second detecting means for detecting engine speed;

calculating means, connected to said first and second detecting means, for calculating a ratio of said air intake amount to said engine speed;

means for calculating an amount of fuel to be injected in accordance with said calculated ratio;

timer means for detecting a predetermined period from the start of said engine until stable idling is assured;

means for compensating said calculated amount of fuel to be not less than an amount corresponding to a predetermined limit value of a fuel-related parameter during said period; and, means for operating said injector means so that the compensated amount of fuel is injected into said engine, wherein said compensating means comprises means for determining whether said calculated ratio of air intake amount to engine speed is smaller than a predetermined minimum ratio, and means for changing said calculated ratio to said predetermined minimum ratio when said ratio is smaller than said predetermined minimum ratio.

3. A fuel injection control system for an internal combustion engine, comprising:

starter means for initiating a start of said engine;

injector means for introducing fuel into said engine;

first detecting means for detecting air intake amount introduced into said engine;

second detecting means for detecting engine speed;

calculating means, connected to said first and second detecting means, for calculating a ratio of said air intake amount to said engine speed;

means for calculating an amount of fuel to be injected in accordance with said calculated ratio;

timer means for detecting a predetermined period from the start of said engine until stable idling is assured;

means for compensating said calculated amount of fuel to be not less than an amount corresponding to a predetermined limit value of a fuel-related parameter during said period; and, means for operating said injector means so that the compensated amount of fuel is injected into said engine, wherein said compensating means comprises means for determining whether said calculated amount of fuel is smaller than a predetermined minimum value, and means for changing said calculated amount of fuel to said predetermined minimum value when said amount of fuel is smaller than said predetermined minimum value.

4. A fuel injection control system according to claim 1, wherein said compensating means comprises means for determining whether said detected intake air amount is smaller than a predetermined minimum value, and means for changing the value of said air intake amount to said predetermined minimum value when said detected air amount is smaller than said predetermined minimum value.

5. A fuel injection control system according to claim 1, wherein said timer means comprises means for detecting whether said engine has reached a predetermined engine speed value corresponding to attaining a complete combustion state and a counter for counting a predetermined number of time pulse signals after the detection of the predetermined engine speed value.

* * * * *